US005655924A

United States Patent [19]

Cross et al.

[11] Patent Number: 5,655,924

[45] Date of Patent: Aug. 12, 1997

[54] ELECTRICAL PLUG RETAINER SYSTEM

[75] Inventors: Andrew L. Cross, Mantua; Thomas J. Luby, Akron, both of Ohio

[73] Assignee: The Dzyne Group, Ltd., Akron, Ohio

[21] Appl. No.: 661,009

[22] Filed: Jun. 10, 1996

[51] Int. Cl.[6] ..... H01R 13/62

[52] U.S. Cl. ..... 439/373; 439/369

[58] Field of Search ..... 439/367, 368, 439/369, 370, 371, 373, 345

[56] References Cited

U.S. PATENT DOCUMENTS

| | | | |
|---|---|---|---|
| 4,457,571 | 7/1984 | Lavine et al. | 439/369 |
| 4,652,069 | 3/1987 | Smith | 439/369 |
| 4,840,577 | 6/1989 | Prouty | 439/373 |
| 5,011,427 | 4/1991 | Martin | 439/373 |
| 5,104,335 | 4/1992 | Conley et al. | 439/369 |
| 5,179,044 | 1/1993 | Muromachi et al. | 439/369 |
| 5,211,573 | 5/1993 | Cross | 439/369 |
| 5,217,387 | 6/1993 | Hull et al. | 439/367 |
| 5,249,337 | 10/1993 | Cross et al. | 24/129 R |
| 5,259,782 | 11/1993 | Giffin | 439/367 |
| 5,273,454 | 12/1993 | Shotey | 439/367 |
| 5,306,176 | 4/1964 | Coffey | 439/367 |
| 5,328,384 | 7/1994 | Magnuson | 439/369 |
| 5,334,042 | 8/1994 | Chevalier | 439/369 |
| 5,336,106 | 8/1994 | Osten | 439/369 |
| 5,336,107 | 8/1994 | Sheryll | 439/369 |
| 5,342,212 | 8/1994 | Francis | 439/149 |
| 5,348,495 | 9/1994 | Kasden | 439/373 |
| 5,382,179 | 1/1995 | Noschese | 439/533 |
| 5,393,243 | 2/1995 | Carmo | 439/369 |

*Primary Examiner*—Hien Vu

*Attorney, Agent, or Firm*—Renner, Kenner, Greive, Bobak, Taylor & Weber

[57] ABSTRACT

A system (10) for retaining a plug (11) carried by a cord (12) in a socket (17) of an electrical receptacle (13) includes, in one embodiment, a plate (14) mountable to the receptacle (13). The plate (14) has opposed lugs (19, 20) on each side of the socket (17). The lugs (19, 20) form opposed slots (21, 22) to receive flanges (32, 33) formed on one end of resilient arms (24, 25) of a retainer (15). In one embodiment, a retention device (27) is formed near the other end of the arms (24, 25) to hold the cord (12).

10 Claims, 3 Drawing Sheets

ELECTRICAL PLUG RETAINER SYSTEM

TECHNICAL FIELD

This invention relates to a system which will retain an electrical plug in a socket. More particularly, this invention relates to such a system which is used with a conventional electrical outlet such that any tension on the cord which carries the plug will not displace the plug from the socket.

BACKGROUND ART

It is oftentimes aggravating to the user of an electrical appliance, such as a vacuum cleaner, to have the power thereto be interrupted during use because the plug has either become loosened or dislodged from the outlet due to various tensions being placed on the power cord. Numerous devices have been designed in an attempt to solve this problem, but all are not without problems of their own. For example, some retaining devices are permanently attached to the wall outlet and can, therefore, present an obstacle when not in use. Others require some type of elaborate modification to the outlet or the plug, while still others require the use of several additional components. Usually such components are, in some complex fashion, attached to the outlet and/or the plug.

The need thus exists for a plug retainer which is inexpensive to manufacture, easy to install, and which does not require extreme modifications to the electrical outlet or plug.

DISCLOSURE OF THE INVENTION

It is thus an object of the present invention to provide a system for retaining an electrical plug in the socket of an electrical outlet.

It is another object of the present invention to provide a retaining system, as above, which is readily attachable to and removable from the plug and the outlet.

It is a further object of the present invention to provide a retaining system, as above, which does not require any elaborate modification to the plug or the outlet.

It is an additional object of the present invention to provide a retaining system, as above, which can be stored out of the way when not in use.

It is yet another object of the present invention to provide a retaining system, as above, which is inexpensive to manufacture and is composed of a minimal number of cooperating parts.

These and other objects of the present invention, as well as the advantages thereof over existing prior art forms, which will become apparent from the description to follow, are accomplished by the improvements hereinafter described and claimed.

In general, a system for retaining a plug carried by a cord in a socket of an electrical receptacle includes a plate which is mounted to the receptacle in such a way that the socket remains exposed. The plate carries opposed lugs which form opposed slots adjacent to the socket. A retention device includes resilient arms at one end and is adapted to hold the cord at its other end. The arms are provided with flanges near one end thereof to be received in the opposed slots.

Preferred exemplary electrical plug retaining systems incorporating the concepts of the present invention are shown by way of example in the accompanying drawings without attempting to show all the various forms and modifications in which the invention might be embodied, the invention being measured by the appended claims and not be the details of the specification.

PREFERRED EMBODIMENTS FOR CARRYING OUT THE INVENTION

Figure 1:
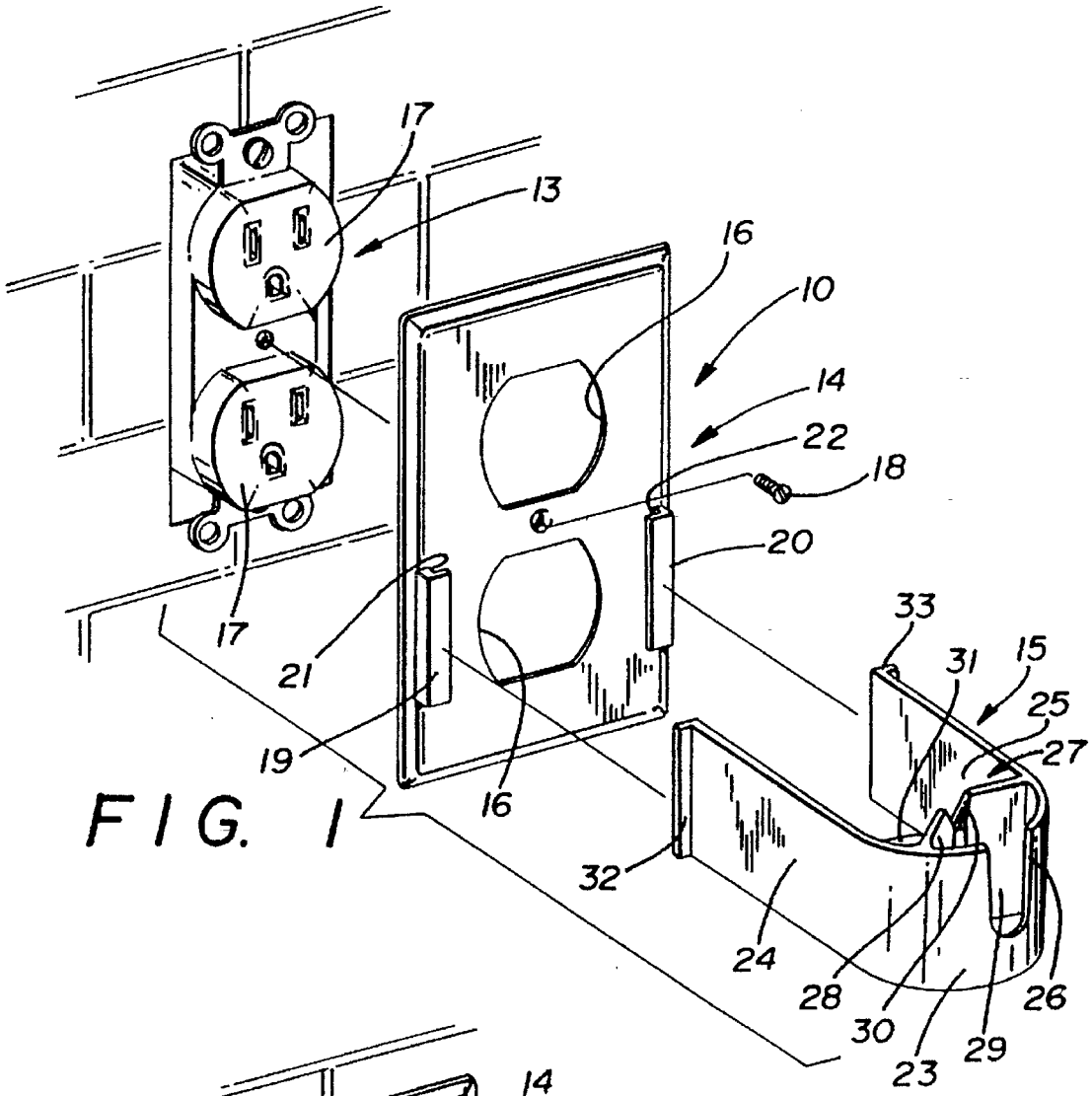
FIG. 1 is an exploded perspective view showing a system for retaining a plug in a receptacle made in accordance with the concepts of the present invention.
Figure 2:
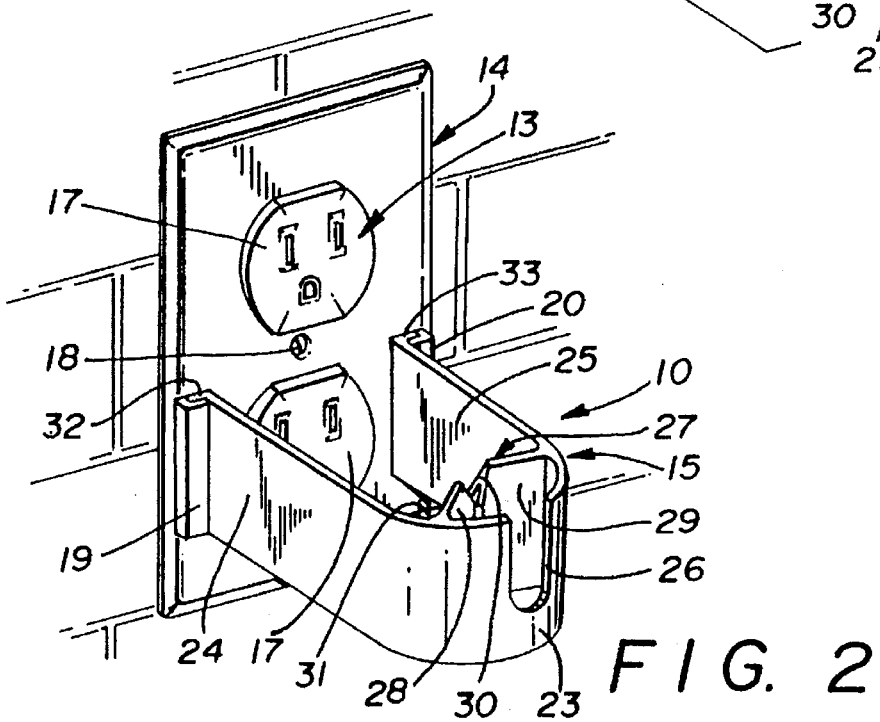
FIG. 2 is a perspective view showing the system of FIG. 1 assembled.
Figure 3:
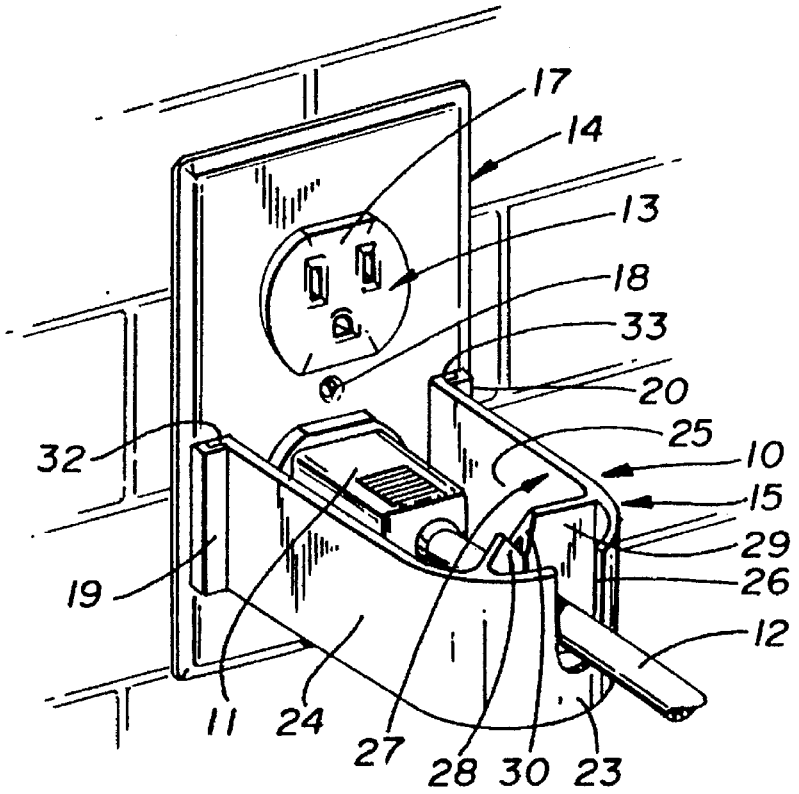
FIG. 3 is a perspective view of the assembled system of FIG. 2 showing a plug in place.

A plug retaining system made in accordance with the present invention is generally indicated by the numeral 10 in the drawings and is adapted to maintain a plug 11, carried by a cord 12, in a conventional wall receptacle generally indicated by the numeral 13. Retaining system 10, as depicted in FIGS. 1–3, includes a modified receptacle face plate, generally indicated by the numeral 14, and a retainer generally indicated by the numeral 15.

Face plate 14 includes the conventional openings 16 which expose sockets 17 of receptacle 13 when plate 14 is attached to receptacle 13, as by a screw 18. Face plate 14 is also provided with at least one set of opposed lugs 19, 20 positioned on each side of and adjacent to a socket 17. While plate 14 is shown as having only one set of lugs 19, 20 positioned adjacent to one of the sockets 17, it is within the scope of the present invention to provide a set of lugs 19, 20 for each socket 17 or to extend the vertical length of lugs 19, 20 so that one set thereof is adjacent to both sockets 17. In any of these configurations, opposed lugs 19, 20 form opposed slots 21, 22, respectively, between lugs 19, 20 and face plate 14.

Retainer 15 is preferably formed of an acrylonitrile-butadiene-styrene copolymer (ABS), or equivalent plastic material having good memory characteristics and able to withstand a wide temperature range. Retainer 15 is generally U-shaped in configuration having an outer face 23 at one end thereof and two longitudinally spaced arms 24, 25 extending from face 23. Face 23 can be rounded, or as shown in the. embodiment of FIG. 4, can be flat. In the embodiment shown in FIGS. 1–3 and 5, face 23 is provided with a slot 26 therein through which cord 12 of the electrical appliance may freely, slidably pass.

To maintain the connection between plug 11 and socket 17, retainer 15 is provided with a retention device generally indicated by the numeral 27 and positioned near and adjacent to face 23. Retention device 27 can be identical to that shown and described in U.S. Pat. No. 5,211,573 to which reference is made, as necessary, for a more complete understanding of the present invention. Thus, retention device 27 includes opposed flexible filaments or rib-like members 28, 29 extending inwardly from arms 24, 25, respectively, but stopping just short of physically intersecting to form a slot opening 30.

As shown in FIG. 3 when system 10 is assembled with plug 11 and cord 12 therein, cord 12 is clamped between or otherwise engaged in slot opening 30 by members 28 and 29. Thus, the strain caused by any pulling on cord 12 is not allowed to break the connection between plug 11 and socket 17, but rather is absorbed by members 28 and 29.

Figure 5:
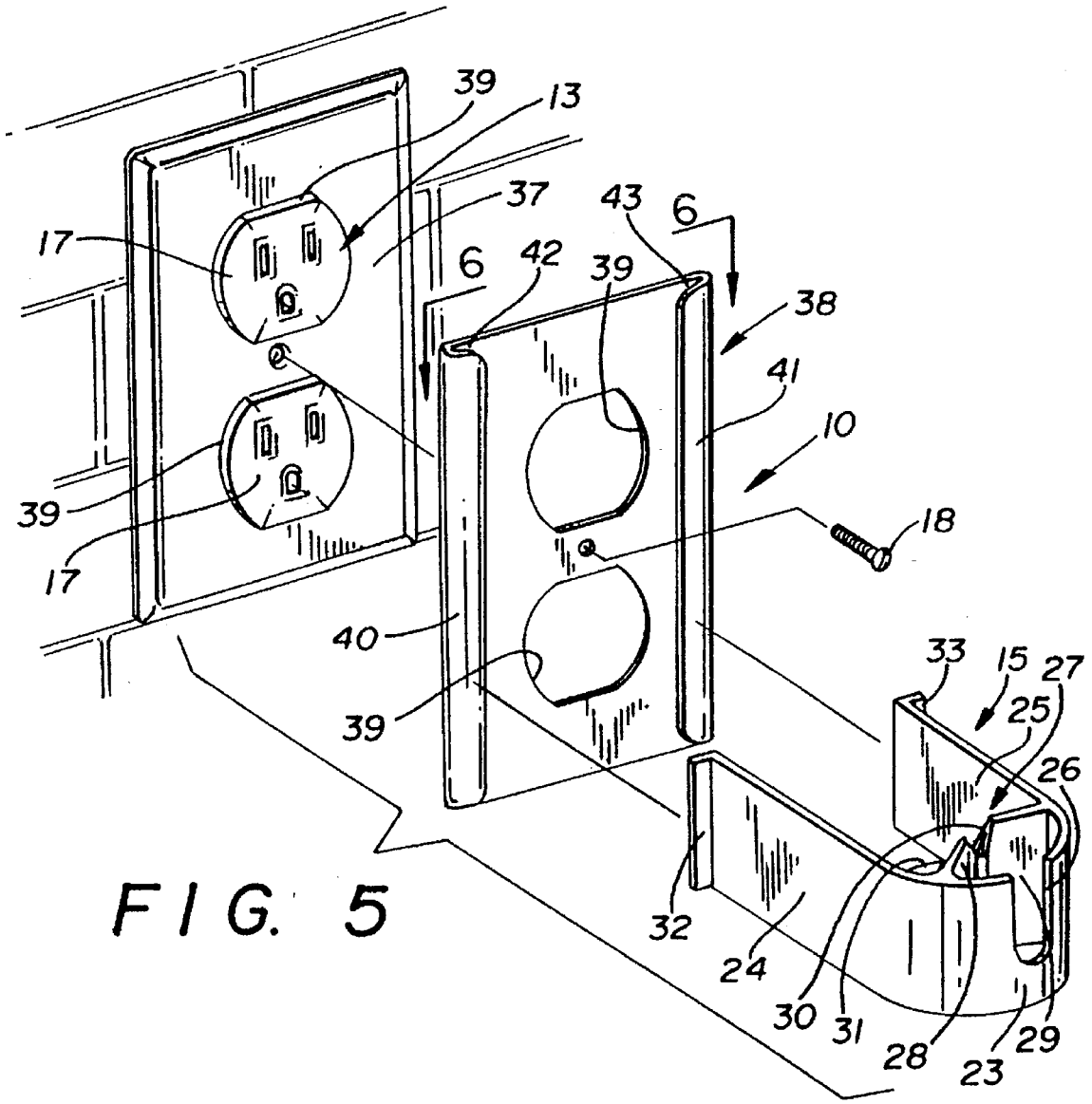
FIG. 5 is one exploded perspective view showing another alternative embodiment of a system for retaining a plug in a receptacle made in accordance with the concepts of the present invention.
Figure 6:
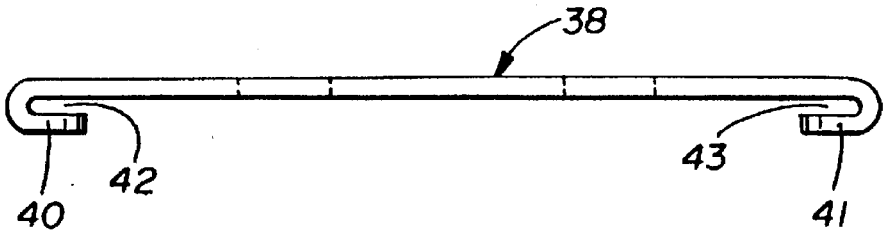
FIG. 6 is a plan view of a portion of the system of FIG. 5 taken substantially along line 6—6 of FIG. 5.

Because of the resilient nature of the plastic material, arms 24, 25 are moveable relative to each other and can be provided with a degree of rigidity at the end near face 23 by ribbing 31, partially shown in FIGS. 1, 2 and 5, and extending between arms 24 and 25. But otherwise, arms 24 and 25 normally have their free ends biased away from each other. Flanges 32 and 33 are formed at these free ends of arms 24 and 25, respectively, and are adapted to be received in slots 21 and 22, respectively, of face plate 14.

Thus, to install retainer 15 in the position shown in FIG. 2, all that need be done is to squeeze arms 24 and 25 slightly toward each other and insert flanges 32, 33 into slots 21, 22, respectively. Releasing arms 24 and 25 permits the outward bias of arms 24 and 25 to maintain retainer 15 on face plate 14. Then, as shown in FIG. 3, plug 11 may be inserted into the socket 17 adjacent to plugs 19 and 20, and cord 12 may be positioned in slot opening 30 to absorb the force of any pulling stress or tension as previously described. When the user is done with the appliance, retainer 15 may be left in position on face plate 14, as desired, or may be readily removed and stored away until a subsequent use.

Figure 4:
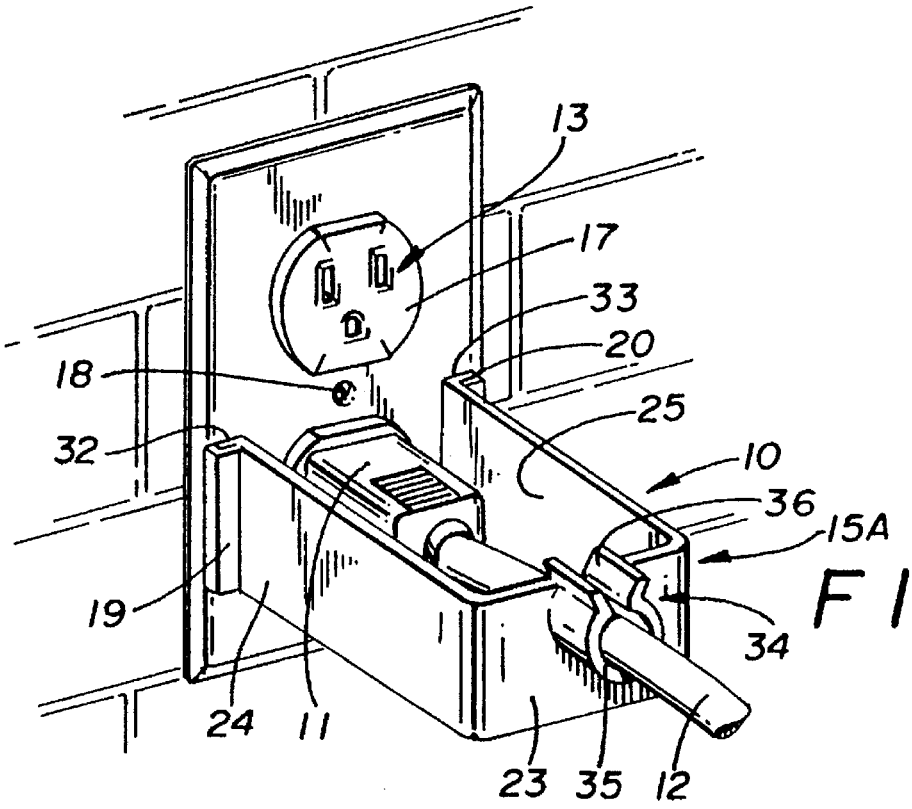
FIG. 4 is a view similar to FIG. 3 showing an alternative embodiment of a retainer of the present invention.

A slightly modified retainer 15A is shown in FIG. 4. In addition to having a flat face 23, as previously described, the retention device 27 of FIGS. 1–3 is replaced by a keyhole-shaped device generally indicated by the numeral 34. Device 34 includes a generally circular cord receiving area 35 opening into a clip-like cord entrance slot 36. Thus, as shown, cord 12 may be snapped into receiving area 35 by passing it through slot 36 and device 34 can thus be used in the same manner as that device described with respect to FIGS. 1–3.

As shown in FIG. 5, face plate 14 need not be substituted for the conventional household face plate. Rather, receptacle 13 can include a conventional face plate 37 and a specially configured cover plate, generally indicated by the numeral 38, may be provided. Cover plate 38 and face plate 37 may both be attached to receptacle 13 by screw 18 and both are provided with the conventional openings 39 which expose sockets 17.

While cover plate 38 may be provided with the single or double set of opposed lugs, such as lugs 19 and 20 shown in FIGS. 1–4, in this embodiment cover plate 38 is shown as being provided with opposed lugs 40, 41 which extend generally the entire length thereof and thus adjacent to both sockets 17. Lugs 40, 41 form opposed channels 42, 43, respectively, which can receive flanges 32, 33, respectively, of retainer 15. Retainer 15 may thus be placed adjacent to either socket 17 in the same manner as previously described, that is, by squeezing arms 24 and 25 slightly together and inserting flanges 32 and 33 into channels 42 and 43.

In view of the foregoing, it should be evident that a device constructed in accordance with the concepts of the present invention will maintain a plug in a socket despite pulling forces being applied to the cord which carries the plug and thus accomplishes the objects of the present invention thereby substantially improving the art.

We claim:

1. A system for retaining an electrical plug carried by a cord in a socket of an electrical receptacle comprising a plate mountable to the receptacle and exposing the socket, opposed lugs carried by said plate and forming opposed slots adjacent to the socket, and a retention device having inwardly flexible resilient arms extending from substantially rigid end means having at least a cord slot to hold the cord at a center of said substantially rigid end means, a distal end of each of said arms having a flange opposite said substantially rigid end means to be received in respective said opposed slots, wherein said arms are flexed inwardly by squeezing said arms and wherein said arms are biased away from each other so that said flanges will engage said opposed slots.

2. A system according to claim 1 wherein said lugs are positioned on each side of the socket when said plate is mounted on the receptacle so that said arms are likewise positioned on each side of the socket.

3. A system according to claim 1 wherein said substantially rigid end means includes a rib extending from each said arm.

4. A system according to claim 3 wherein said ribs extend toward each other and form a slot opening therebetween, the cord being receivable in said slot opening.

5. A system according to claim 4, said substantially rigid end means including a flat face perpendicularly connecting said arms to one another.

6. A system according to claim 1 wherein said substantially rigid end means includes a key-hole shaped device centrally positioned between said arms near said other end of the retention device.

7. A system according to claim 6 wherein said key-hole shaped device includes a generally circular cord receiving area opening upwardly into a cord entrance slot.

8. A system according to claim 1 wherein the receptacle includes a plate exposing the socket, said plate being mountable to the receptacle in a position adjacent to the plate of the receptacle.

9. A system according to claim 1 wherein the receptacle includes a plurality of sockets, said plate exposing the plurality of sockets, and said lugs and slots being adjacent to the plurality of sockets.

10. A system according to claim 9 wherein said resilient arms are received in said opposed slots adjacent to a selected one of the sockets.

* * * * *